United States Patent [19]

Maroney et al.

[11] Patent Number: 4,756,366

[45] Date of Patent: Jul. 12, 1988

[54] WELL SERVICING METHODS USING A HYDRAULIC ACTUATED WORKOVER MAST

[75] Inventors: Peter F. Maroney, Bixby, Okla.; Frank C. Blalock, Brandon, Miss.

[73] Assignee: Crane Carrier, Co., Tulsa, Okla.

[21] Appl. No.: 24,254

[22] Filed: Mar. 10, 1987

[51] Int. Cl.[4] ..... E21B 19/08; E21B 31/00

[52] U.S. Cl. ..... 166/250; 166/301; 166/385; 254/361; 254/377

[58] Field of Search ..... 166/301, 381, 385, 72, 166/67, 75.1, 98, 99, 250; 254/377, 361, 323, 378

[56] References Cited

U.S. PATENT DOCUMENTS

| | | | |
|---|---|---|---|
| 3,152,642 | 10/1964 | Bodine, Jr. | 166/301 |
| 3,895,779 | 7/1975 | Cassez et al. | 254/361 |
| 4,043,434 | 8/1977 | Braschler | 188/296 |
| 4,187,681 | 2/1980 | Johnson | 254/361 |
| 4,324,387 | 4/1982 | Steinhagen | 254/377 X |
| 4,404,891 | 9/1983 | Turnquist et al. | 254/377 X |
| 4,454,912 | 6/1984 | Frohlich et al. | 166/72 X |
| 4,658,901 | 4/1987 | Alexander | 166/301 |

*Primary Examiner*—Stephen J. Novosad

*Attorney, Agent, or Firm*—Head & Johnson

[57] ABSTRACT

A portable workover rig for lowering and raising objects such as pipe into and out of a borehole and includes a mast which can be raised from the horizontal position to a vertical position. a first hydraulic motor drives a sandline drum and a second hydraulic motor drives a mainline drum. A normally closed pilot operated check valve provided in the power hydraulic fluid conduit can be opened to permit freewheeling of the main drum allowing heavy objects to free fall in the wellbore. The mainline drum's motor is controlled by a control valve having a counterbalance feature which when a heavy load is being lowered into the well bore prevents the drum from rotating faster than it would be driven by the power hydraulic fluid. A similar but separate control system is used for the sandline drum.

3 Claims, 8 Drawing Sheets

WELL SERVICING METHODS USING A HYDRAULIC ACTUATED WORKOVER MAST

BACKGROUND OF THE INVENTION

1. Field of the Invention

The claimed invention relates generally to well drilling and servicing equipment and more specifically to portable rigs which have a mast which is horizontal when being moved and is vertical when in use and which is used to lower and raise objects into and out of well bores drilled in the earth.

2. Setting of the Art

Production wells, i.e. wells which are drilled in the earth to produce oil and gas, must be "worked over" or serviced from time to time which includes replacing of downhole equipment or the lowering or raising of objects into the well bore such as tubing, rods, tools and so forth. For example, if the production string of casing which is set in the well bore to keep the production fluid from escaping is damaged or leaking, it may be necessary to pull all or part of the casing from the well bore and replace it with a new string or partial string of casing or pipe. Most often an artificial means of raising the fluid from the bottom of the well bore is used. One such system involves the use of sucker rods which are hung in a well and reciprocated to drive a downhole pump. Sometimes the sucker rods must be pulled to replace damaged or broken rods, worn or damaged pumps, etc. Another system is the gas lift. However, frequently the gas lift valves are not working properly and therefore, it may be necessary to pull the tubing and exchange the gas lift valves prior to placing back into the well. Also, when the tubing, which is hung in the well bore through which the well fluids are produced becomes plugged with sand, it is necessary to insert a small diameter work string into the pipe to remove or flush out the material clogging the flow of oil through the pipe. Other remedial service operations include gravel packing, fishing jobs, plug backs and so forth.

When such service operations become necessary it is quite common to use a portable workover rig which can be moved to the well site and set up. Generally, these rigs consist of a derrick or mast which supports pulleys or block and tackle arrangements operable to pull the pipe string from the well bore as well as lower the pipe string and workover tools into the well itself. These workover rigs normally have what is called a mainline drum about which a heavy cable is wound and the free end is connected over the crown block at the top of the well bore and is connected to what is called a traveling block. By rotating the drum the traveling block can be raised or lowered with the drilling mast as is necessary. Another drum is called a sandline drum (not used with the traveling block) and which has a line wound about it and up over the crown block and is then connected to an object such as a swab mandrel which is to be lowered into the well bore to a selected depth. Nearly all of the conventional workover rigs have these mainline drums and the sandline drum driven by a chainlink drive. A clutch is then necessary to engage and disengage the drive chain. With these chain driven systems it is difficult to make the drum rotate in a controlled manner when lowering heavy objects into the well bore. With the chain drive you have to let it freewheel by releasing the clutch and depend entirely on the drum brake.

Another workover operation is the removing of objects which become stuck in the well bore. The tubing is pulled and stretched until the load limit is reached. The clutch is released allowing the tubing to contract and is then caught with the mechanical drum brake, thus imparting a shock down the tubing which may free it from its restraint.

SUMMARY OF THE INVENTION

This invention includes a portable mast which can be raised from a horizontal position to a vertical position. It includes a mainline drum which has a cable which goes over the crown block for raising and lowering the traveling block. There is also a sandline drum which has a line thereon which goes over the crown block and is used for lowering various objects into a well bore and removing them therefrom. The sandline drum is primarily used in lifting fluids or "swabbing" through the casing or tubing string. There is an identical hydraulic control system for each drum. One or two hydraulic motors are provided for each drum. There is a power source for providing hydraulic power fluid under pressure to the motor. If the motor is rotating faster than the power fluid can flow therethrough (such as when lowering a heavy object into the well bore) there is developed a cavitation on the power fluid inlet port. When this occurs it is sensed by the control valve and back pressure is held on fluid exhaust conduit from the motor until the vacuum disappears. This prevents the motor from going too fast and prevents cavitation. As soon as the cavitation disappears then the restriction on the outlet of the power fluid from the motor is removed and the normal operations are resumed. This may occur several times a second. This does prevent the motor and associated drum from "running away". It in effect is a braking system. The control valve also senses the power which is needed to drive the hydraulic motor for the mainline drum and controls a shuttle valve which controls the power pump so that the proper amount of fluid at the proper pressure is provided by the power source.

Means are also provided to permit freewheeling without a clutching mechanism. A pilot operated check valve is also provided so that upon being actuated it relieves the power fluid from the control valve so that the motor has no power fluid flowing thereto and thus becomes freewheeling. This is sometimes useful when lowering objects into the well bore. If this feature is used then there is also provided a powered disc brake which is used on the mainline drum so that it can be stopped when needed. Another means of restricting the freewheeling is by again applying power fluid to the hydraulic motor driving the drum.

DESCRIPTION OF THE DRAWINGS

FIG. 4 is the upper left hand quadrant, FIG. 5 is the upper right hand quadrant, FIG. 6 is the lower left hand quadrant and FIG. 7 is the lower right hand quadrant.

DETAILED DESCRIPTION OF THE INVENTION

Figure 1:
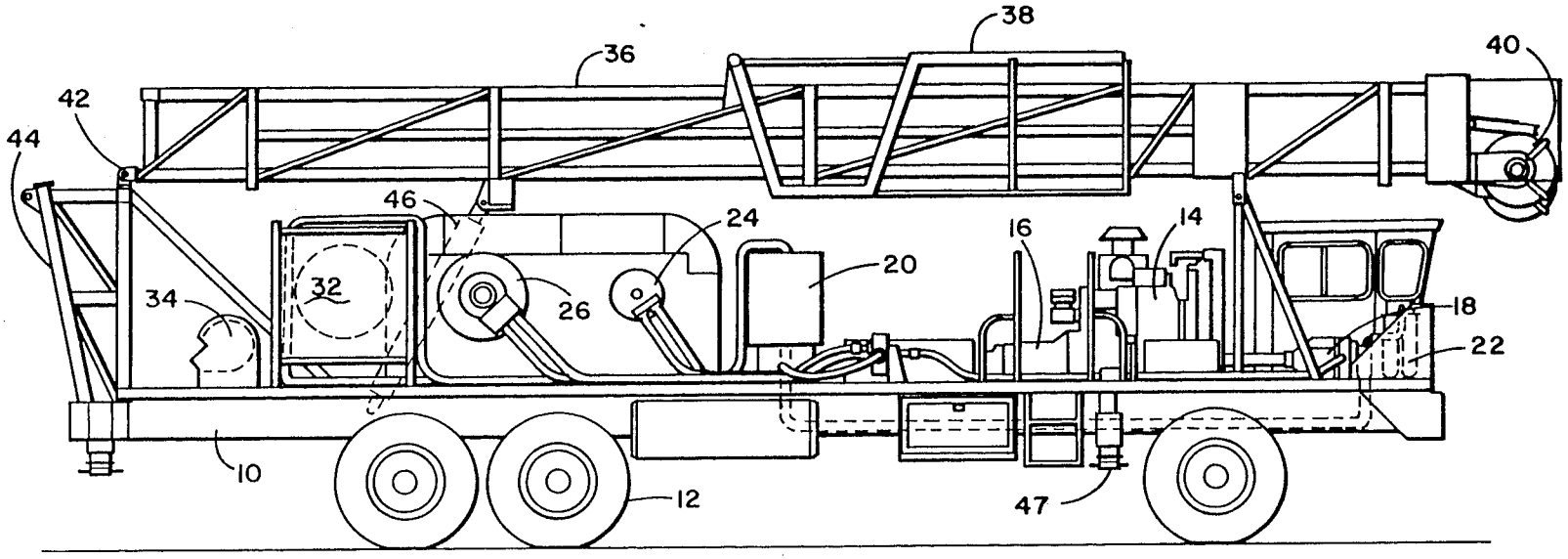
FIG. 1 illustrates a hydraulic driven mast structure useful for servicing wells drilled in the earth.

Attention is first directed to FIG. 1 which shows the hydraulically driven mast mounted on a vehicle and in its lowered position. Shown thereon is a frame 10 mounted on wheels 12. The power is provided by engine 14 which is connected to transmission 16. Engine 14 also drives hydraulic pumps 18. The hydraulic fluid for pump 18 is stored in hydraulic tank or reservoir 20 which is provided with the proper flow lines through filter 22 to the hydraulic pump 18. The power fluid from hydraulic pump 18 is conveyed through appropriate flow lines to, sandline drum hydraulic motor 24 and also to the main drum hydraulic motor 26.

Figure 3:
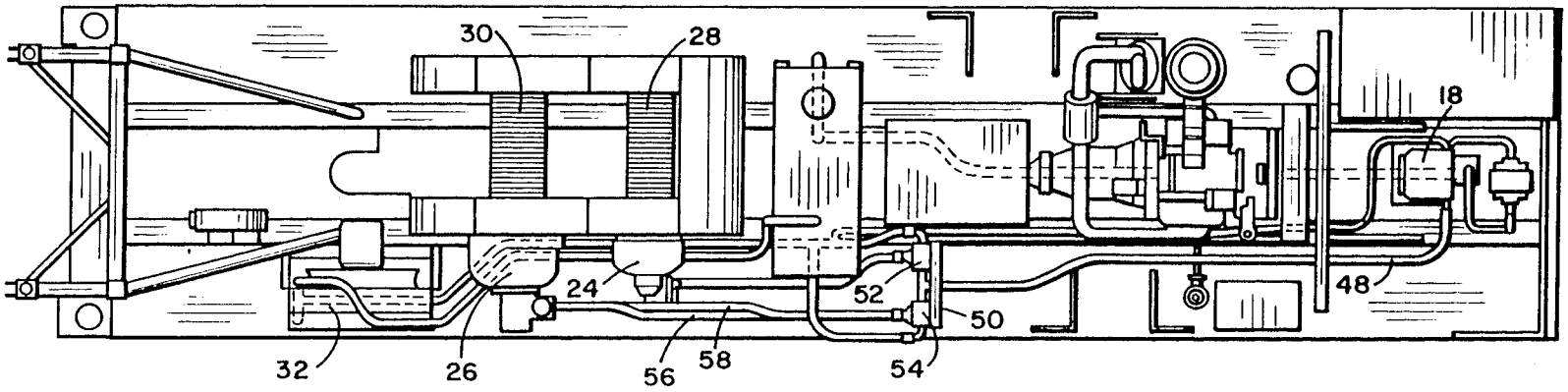
FIG. 3 is a plan view of FIG. 2.

Sandline drum hydraulic motor 24 is connected to a sandline drum 28 as shown in FIG. 3. It is about this drum that a cable or line is mounted and it is used with the mast in the conventional system for lowering and raising objects from a surface to the bottom or intermediate points in the borehole. The mainline drum hydraulic motor 26 is connected to main drum 30 as also shown in FIG. 3. This mainline drum 30 has a cable which is heavier than the cable about sandline drum 28 and is used to raise and lower the traveling block in a conventional manner.

The hydraulic oil is also provided with an oil coooler 32 through which the warm oil will flow so it can be cooled before returning to the hydraulic tank 20 or to the pump 18.

Figure 2:
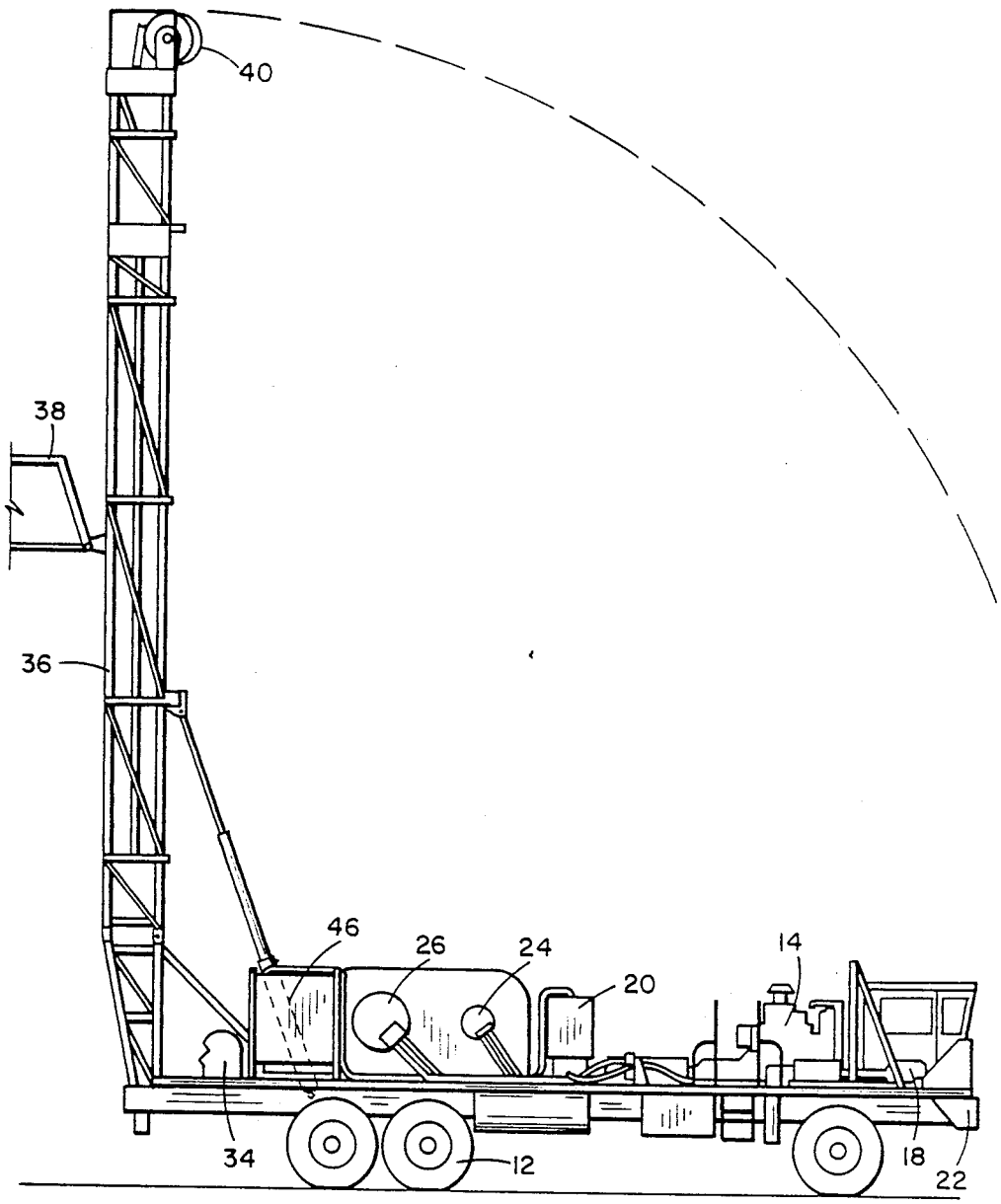
FIG. 2 is the drilling mast of FIG. 1 with the mast in a raised position.

Also shown in FIG. 1 is a deadend anchor 34, a mast 36 having a tubing board 38, a crown 40 and a rodman's basket. The mast 36 is pivoted at pivot 42 to mast base 44. The operation of the mast is controlled by hydraulic cylinder 46 to raise it to the position shown in FIG. 2. Four leveling jacks 47 are also provided as is normal. The system will also include other conventional features which are well known and their description herein is not necessary to explain the present invention.

Attention is next directed specifically to FIG. 3 which shows the hydraulic pump 18 which is a piston type pump which has outlet line 48 which is connected to a manifold 50 which provides fluids to sandline control valve 52 and to mainline drum control valve 54. A more detailed description of the hydraulic flow system will be given in connection with FIGS. 4, 5, 6 and 7. However, by examining FIG. 3 the general pattern can be established. Main drum control valve 54 can direct fluid to the main drum hydraulic motor 26 through either conduit 56 or 58 depending on which way it is desired for the motor 26 to operate. Likewise, sandline control valve 52 can direct fluid through either of two lines to sandline drum hydraulic motor 24 so that if the power fluid is directed into one line the motor will turn one way and if it is directed into the second line it will rotate in the opposite direction. An oil cooler 32 is provided to remove heat from the hydraulic fluid or oil. In certain operations, the oil or hydraulic fluid will be heated. For example, sometimes when lowering a heavy load on the sandline the drum will try to turn faster than the hydraulic motor 24. In order to prevent this from happening, one will restrict the flow of fluid leaving the hydraulic motor so that it cannot turn excessively fast. This will permit controlled lowering of the load. The method or system for doing this will be described more fully in the description of FIGS. 4, 5, 6 and 7. This control or braking action on the drums can apply to either the sandline drum hydraulic motor 24 or the main drum hydraulic motor 26.

Figure 4:
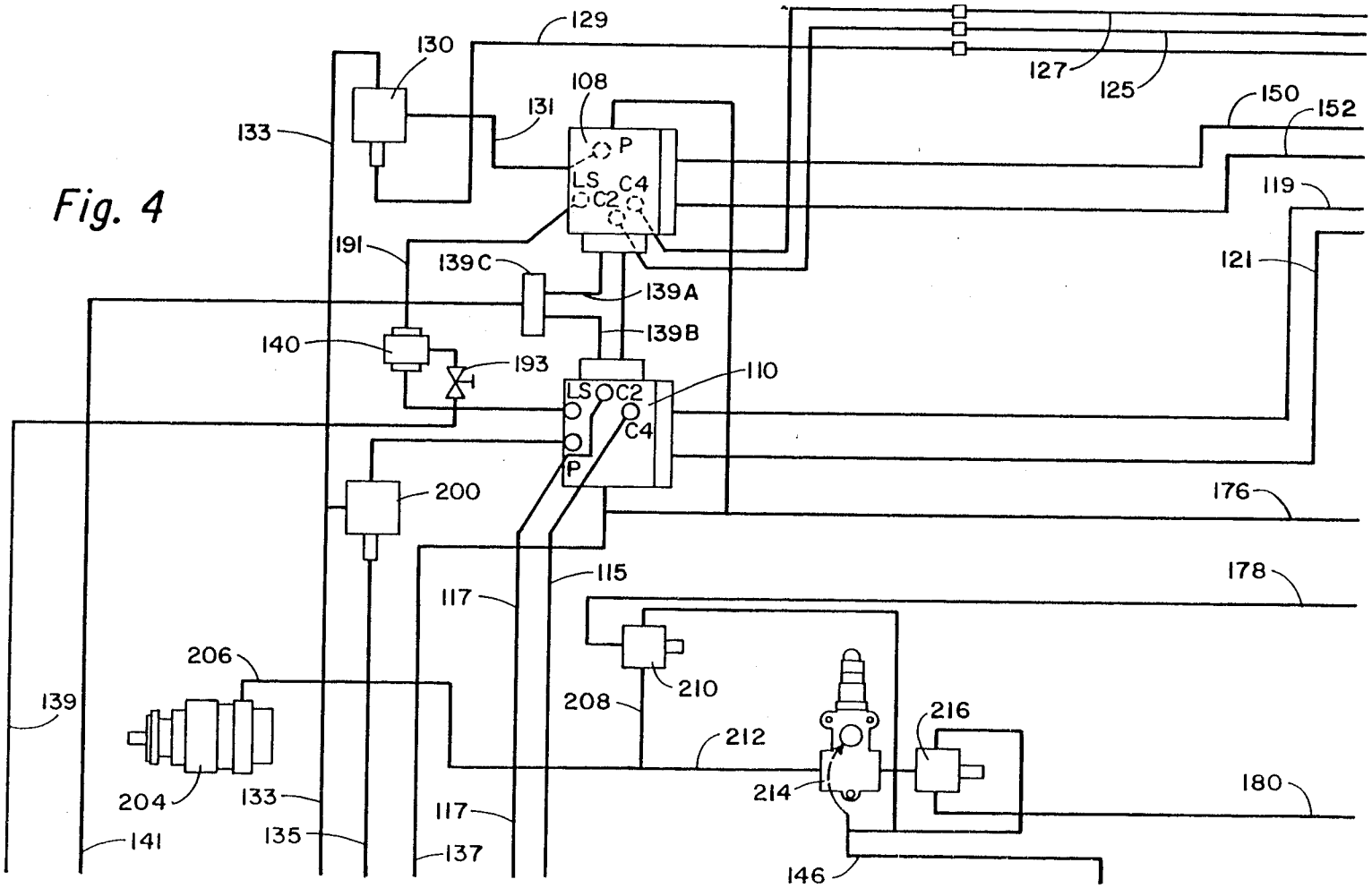
FIGS. 4, 5, 6 and 7 when taken together show the simplified hydraulic flow diagram for the hydraulic mast of our invention.
Figure 5:
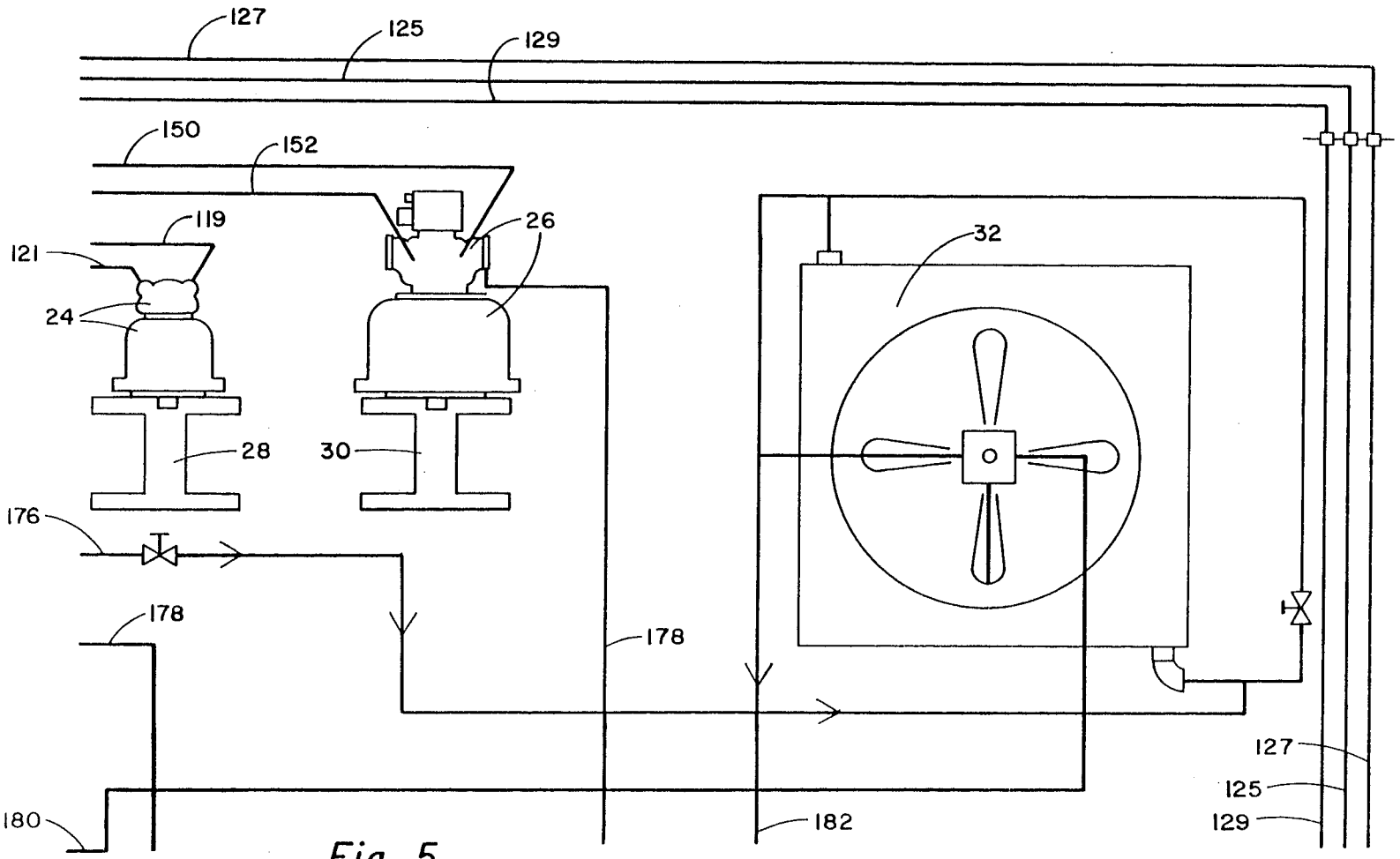
Figure 6:
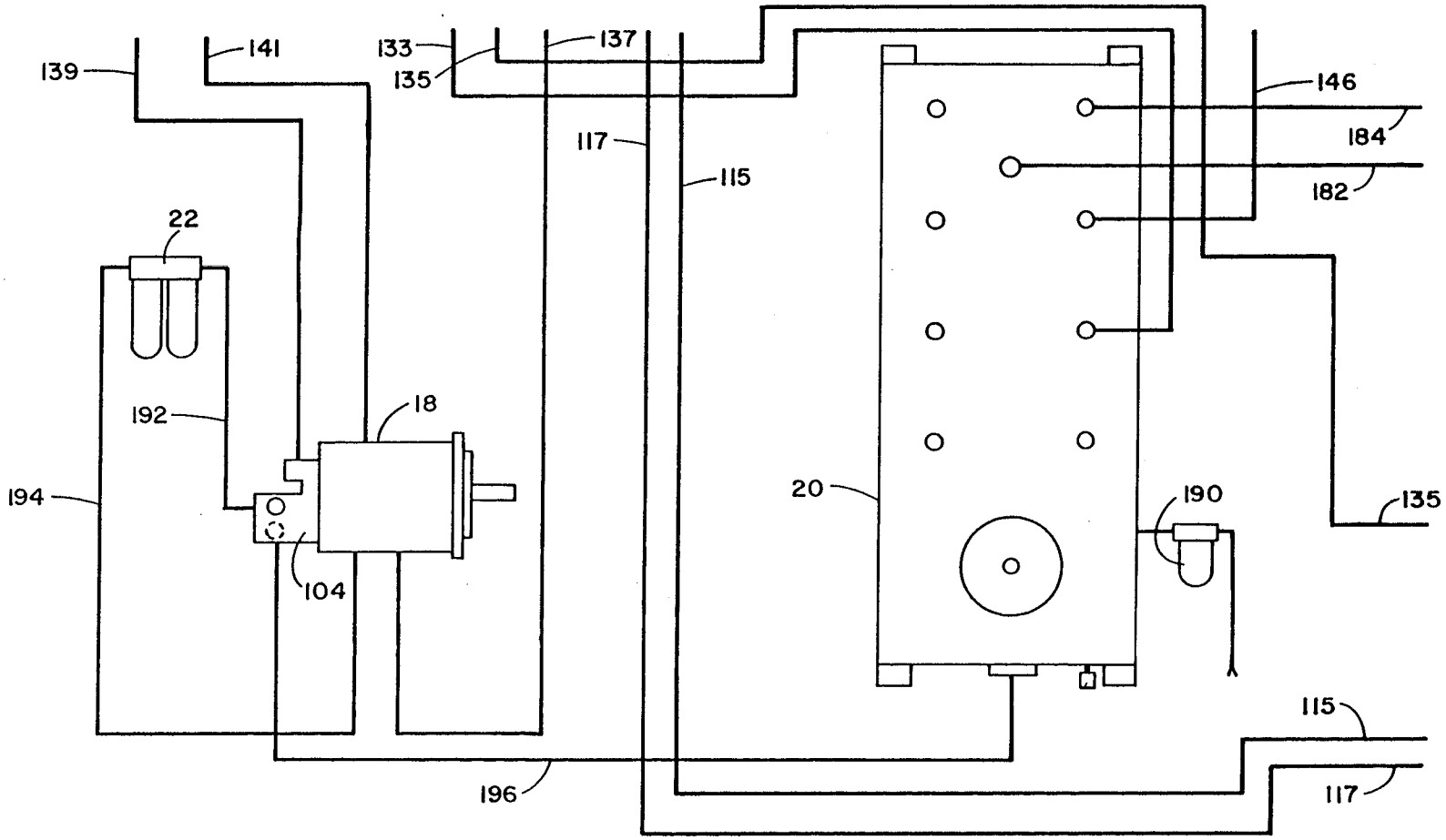

Attention is next directed to FIGS. 4, 5, 6 and 7 which shows a simplified flow diagram of the hydraulic system of this invention. In FIG. 6 the principal components are hydraulic fluid reservoir storage 20 and hydraulic piston pump 18. In association with piston pump 18 is gear pump 104 which pumps oil through line 192, through filter 22 and through line 194 to provide supercharged oil to piston pump 18. The power oil from piston pump 18 is flowed through conduit 141 to the manifold 139C through lines 139A to control valve 108 for the main drum motor and through line 139B to control valve 110 for the sandline motor. These control valves are shown in FIG. 4.

In FIG. 5, that is, there is a sandline drum 28 driven by motor 24 and a mainline drum 30 driven by motor 26, and an oil cooler 32. Power to motor 24 is provided through valve 110 through conduits 119 and 121. Power for the mainline motor 26 is provided through conduits 150 and 152. Conduit 182 returns hydraulic fluid from the cooler to the reservoir 20.

Figure 7:
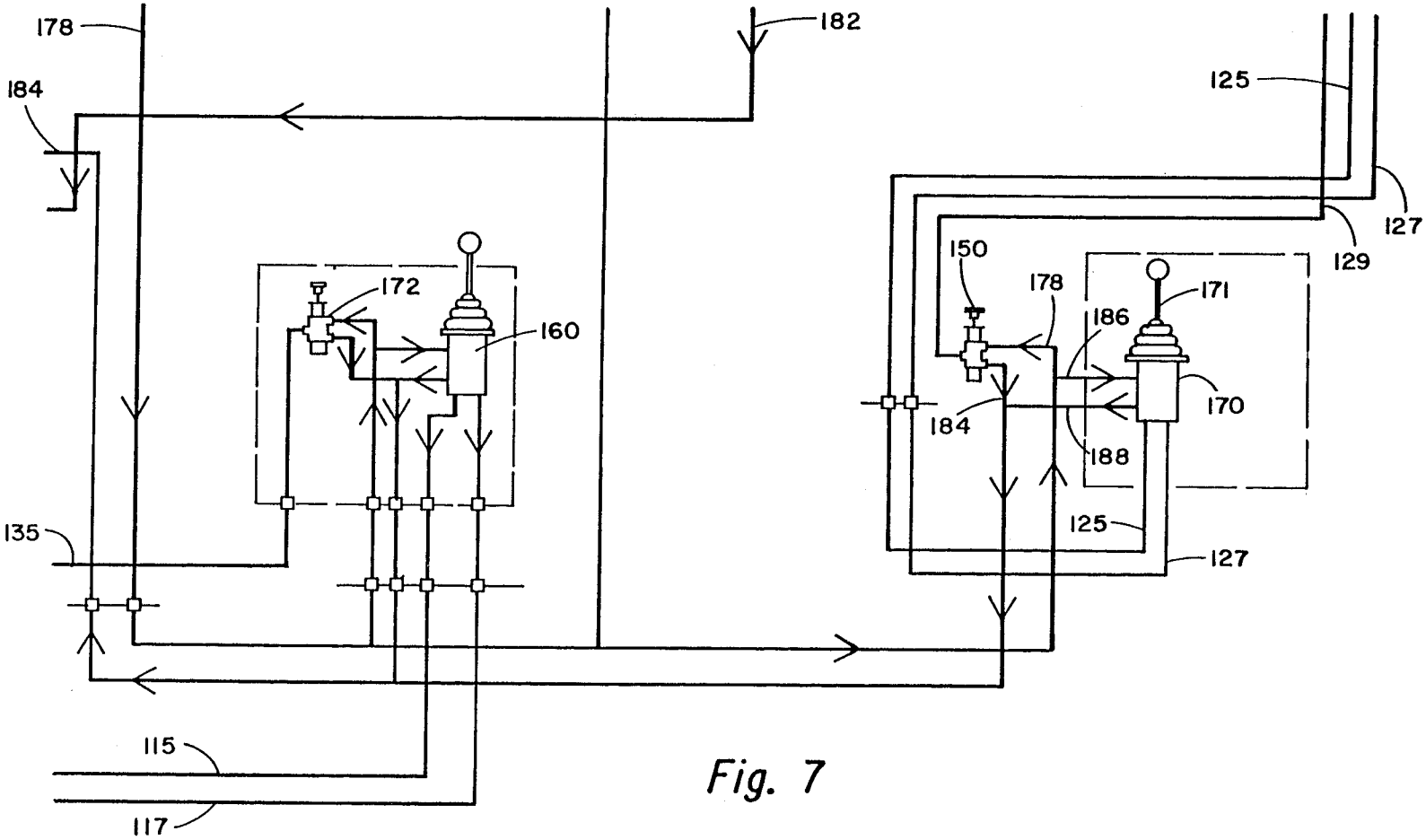

In FIG. 7 there is shown the operating mechanism to be used by an operator for controlling the control valves. For the main line control valve 108 there is provided a valve 170. When lever 171 is in one position it causes a motor 26 to rotate in one direction and when in a second position it causes the motor to go in a reverse direction. Fluid under pressure flows through line 178 through branch line 186 to control valve 170. By moving valve lever 171 in one direction, in one position the control fluid is flowed through line 127 to the inlet designated C4 of mainline drum control valve 108 which causes fluid to flow through line 150 to motor 26 to cause it to rotate in one direction. When the valve lever 171 is in a second position it causes power control fluid to flow through line 125 to the inlet designated C2 of control valve 108 and causes the valve to have the power fluid to flow through line 152 so that motor 26 is caused to rotate in the reverse position.

Valve 108 is commercially available from Vickers, Inc. and is identified as CMX 400. This valve comes with a Vickers drawing which contains the designation indicated on the present drawing. The spent control fluid is exited from valve 170 through line 188 to conduit 184 where it goes back to the storage tank 20. The control console in FIG. 7 for the main motor also includes a valve 150. When the lever of valve 150 is in one position, it releases pressure from the control line 129 back through line 184 to the hydraulic fluid reservoir storage tank 20. This permits normal operations. However, sometimes when drilling in a hole it may be desired to permit the motor such as motor 26 to free wheel. That is, run without much resistance from fluid within the motor. If this is desired, valve 150 is put into a second position so that the control fluid on line 178 passes through the valve 150 to line 129 which is connected to a pilot operated check valve 130 as shown in FIG. 4. This valve 130 stays closed until valve 150 is opened. Then valve 130 operates as a check valve permitting fluid to flow from line 131 to 133. Pilot operated check valve 130 is commercially available from Fluid Controls, Inc. and is designated 4K19. When it is desired to permit motor 26 to freewheel, valve 150 in FIG. 7 is opened and fluid pressure in line 129 causes the pilot operated check valve 130 to open letting fluid escape through line 131 from valve 108 and permits the power fluid from motor 26 to largely escape so that there is very little hydraulic fluid to impede the rotation of the motor and the drum. The above described valve 108 has an internal part called a counter-balance valve. When using the mainline drum to lower a heavy load into a hole, the motor tries to run away and in effect becomes a pump and wants to turn faster than the power fluid supply pump can supply power fluid to it. The fluid to the front side of the motor, that is the power input side, tends to cavitate, that is the fluid in the line tries to cavitate at the motor. This lower pressure or partial vacuum closes the counterbalance valve within control valve 108. So when that hydraulic fluid cavitates, the pressure is lost in the counterbalance pilot and the control valve 108 closes and stops the hydraulic fluid from coming out of the motor 26. This stops the hydraulic fluid from coming out of the exhaust side of the motor and thus puts pressure on the back side of the motor 26. This builds up pressure in the front of the motor. As the pressure builds up, the cavitation disappears and the counterbalance valve permits power fluid to go to the motor again. Then when the motor starts to cavitate again the counterbalance mechanism stops it and the cycle just described is repeated. This may occur several times a second so that there is a smooth operation. Thus, with this system the load as it is lowered into the hole will not run out of control.

We shall now discuss briefly that part of the system that controls the power pump 18. This includes a shuttle valve 140 shown in FIG. 4 which has a conduit 191 connected to the LS connection on control valve 108. The outlet of shuttle 140 is connected through a valve 193 to conduit 139 which controls piston pump 18.

Valve 110 for the sandline drum 28 and associated control and power system is identical to that and operates the same as that for the main drum just discussed. This includes in FIG. 7 a valve 160 and a valve 172 which are identical to valve 170 and 150. Valve 110 in FIG. 4 is identical to valve 108 and it also has pilot operated check valve 200 connected to valve 110 which is the same as valve 130. The outlet of valve 172 is connected through line 135 to valve 200. Control lines 115 and 117 connect valve 160 to mainline control valve 110 similarly as lines 125 and 127 connect valve 170 to mainline valve 108. Line 135 is shown in FIGS. 4, 6 and 7 so that the continuity of the line can be followed between valve 172 and valve 200. Line 137 connects valve 110 to power pump 18. Line 176 is indicated in FIGS. 4 and 5 and connects the output from valve 108 and 110 to oil cooler 32.

Attention will now be directed to that part of the system having to do with the supply of control hydraulic fluid in contrast to the power hydraulic control fluid. This includes a pump 204 shown in FIG. 4 which has an outlet line 206 which is connected through branch line 208 to pressure reducing valve 210 and branch 212 which leads to a relief valve 214. The outlet of valve 210 is supplied through conduit 178 to valves 170, 150, 172 and 160 shown in FIG. 7. Sequence control valve 216 maintains a minimum control pressure then directs oil through line 180 to the cooler motor when a preset pressure is reached. In FIGS. 6 and 7 flow line 182 connects the reservoir 20 to oil cooler 32. Line 182 connects reservoir 20 and oil cooler 32.

Figure 8:
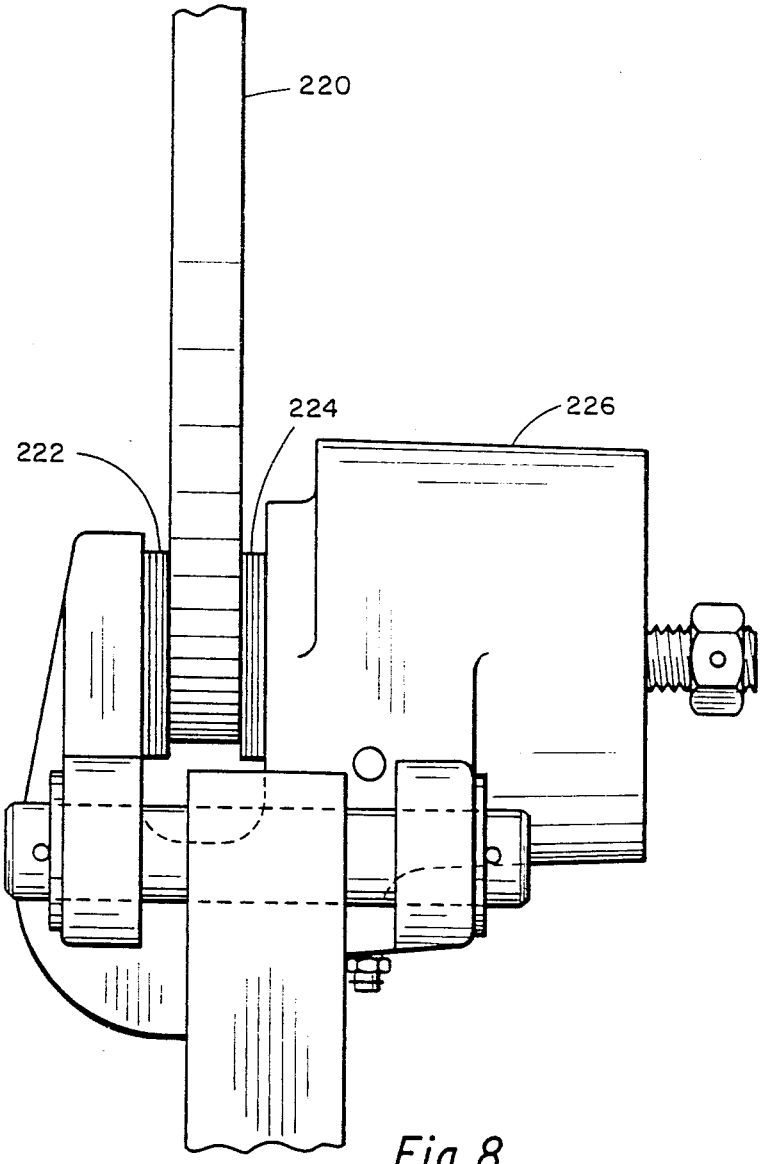
FIG. 8 shows a braking system useful with the hydraulic driven mast.

Attention is next directed to FIG. 8 which shows a braking system to be used in conjunction with the mainline drum 30. This includes mounting the frame 226 of the brake so that the disc 220 which is mounted on the main drum is positioned between pads 222 and pads 224. When one desires to brake the drum then the pads 222 and 224 are driven toward the disc 220. This is particularly useful when freewheeling as described above. It is thus seen that one can operate valve 150 to permit the mainline drum 30 to freewheel yet we still can control it if we need to stop it by using the disc brake drums described in connection with FIG. 8. On the other hand, if one does not want to freewheel, I can rely on the counterbalance valve within valve 108 to prevent the motor 26 from rotating faster than the fluid which is powered to it. The disc brake of FIG. 8 is an emergency parking brake that can be used infrequently when pipe is stuck. Normal operational braking is done by means of the counterbalance valve. Thus, I have complete control whether I am freewheeling or just lowering the device into a hole.

While the invention has been described with a certain degree of particularity, it is manifast that many changes may be made in the details of construction and the arrangement of components without departing from the spirit and scope of this disclosure. It is understood that the invention is not limited to the embodiments set forth herein for purposes of exemplification but is to be limited only by the scope of the attached claim or claims including the full range of equivalency to which each element thereof is entitled.

What is claimed:

1. A method of removing a stuck object from a well by operating a hydraulically operated workover rig which has a mast with a crowm and a traveling block, a first winch with a brake, a first hydraulic motor, a line connected to said winch, and tubing in a well, which comprises:

(a) connecting the end of said line to said tubing;
(b) providing hydraulic power fluid to drive said first motor to drive said first winch to put high stress on said tubing;
(c) abruptly cutting off the hydraulic power fluid to said motor to allow said tubing to contract
(d) then operating said brake to impart a shock down said tubing;
(e) repeating steps (b) and (d) above as necessary until the object becomes unstuck.

2. A method of lowering objects into a well bore using a mast having a crown block, a first drum on which a line is mounted, a first hydraulic motor for driving said first drum, the steps which comprises:

running the end of said line over such crown block and attaching it to said object;
supplying hydraulic fluid to the inlet of said first motor to cause it to drive said first drum;
detecting the occurrence of cavitation on the inlet to said motor;
momentarily restricting the flow of spent fluid from said motor each time cavitation is detected on the inlet to said motor due to the speed at which the object is falling through the well bore until the cavitation disappears so that the object is lowered at a controlled rate.

3. A method as defined in claim 2 in which a counterbalancing valve is used in the step of momentarily restricting the flow of spent fluid.

* * * * *